US011690420B1

(12) United States Patent
Shaffa

(10) Patent No.: US 11,690,420 B1
(45) Date of Patent: Jul. 4, 2023

(54) COSTUME WING USING SYNTHETIC FEATHER FORMS

(71) Applicant: Payman Shaffa, Chatsworth, CA (US)

(72) Inventor: Payman Shaffa, Chatsworth, CA (US)

( * ) Notice: Subject to any disclaimer, the term of this patent is extended or adjusted under 35 U.S.C. 154(b) by 0 days.

(21) Appl. No.: 17/671,213

(22) Filed: Feb. 14, 2022

(51) Int. Cl.

| | |
|---|---|
| ***A41G 11/02*** | (2006.01) |
| ***A41G 11/00*** | (2006.01) |
| ***A63J 7/00*** | (2006.01) |
| ***A63H 33/00*** | (2006.01) |
| ***A41F 15/00*** | (2006.01) |
| ***A41D 27/08*** | (2006.01) |

(52) U.S. Cl.
CPC ..... *A41G 11/02* (2013.01); *A41D 27/085* (2013.01); *A41F 15/002* (2013.01); *A41G 11/00* (2013.01); *A63J 7/005* (2013.01); *A63H 33/00* (2013.01)

(58) Field of Classification Search
CPC ..... A63H 33/00; A63J 7/005; A63G 11/00; A63G 11/02
USPC ..... 446/26, 28, 84; 472/33
See application file for complete search history.

(56) References Cited

U.S. PATENT DOCUMENTS 2,244,444 A * 6/1941 Burgess ..... A63B 21/4025 244/64
2,810,576 A * 10/1957 Massey ..... A41D 11/00 2/265
3,013,797 A * 12/1961 Schwartz ..... A63J 7/00 D2/741
4,325,996 A * 4/1982 Krietemeier ..... A63H 3/00 428/6
4,736,847 A * 4/1988 Wang ..... A63H 3/04 D6/665.1
D351,493 S * 10/1994 DeCinque ..... G09F 21/02 D2/741
5,432,991 A * 7/1995 Godleski ..... G09F 21/02 116/306
5,713,603 A * 2/1998 Carter ..... A63C 17/00 280/810
D527,171 S * 8/2006 Frederick ..... D2/741
7,175,496 B1 * 2/2007 Lund ..... A63J 7/005 446/28
8,087,969 B2 * 1/2012 Sun ..... A63J 7/005 446/28

(Continued)

OTHER PUBLICATIONS

Push_reset, "How to Make Costume Wings" (Archive Capture Dec. 2020), instructables craft, https://www.instructables.com/How-to-Make-Costume-Wings/ (Year: 2020).*

*Primary Examiner* — Joseph B Baldori
(74) *Attorney, Agent, or Firm* — Donald R. Boys; Central Coast Patent Agency LLC

(57) ABSTRACT

A wing costume article of manufacture has a semi-rigid support structure formed in a symmetrical shape emulating a shape of a set of wings, a fabric liner formed over the semi-rigid support structure, a plurality of synthetic feathers cut from synthetic foam sheet material, the synthetic feathers cut in a variety of lengths and widths, each with a first end and a second end, the second ends fastened to the fabric liner in a manner to present the plurality of feathers outward simulating a set of natural wings, and a harness interface configured to engage the wing costume by the semi-rigid support structure to the upper back of a wearer, presenting the wing costume as the set of wings.

7 Claims, 6 Drawing Sheets

(56) References Cited

U.S. PATENT DOCUMENTS

| | | | | |
|---|---|---|---|---|
| 8,196,684 | B2 * | 6/2012 | Caiozza | B64D 17/00 180/2.2 |
| 9,609,899 | B1 * | 4/2017 | Gadler | B63B 32/60 |
| 10,704,761 | B1 * | 7/2020 | Zhu | A63H 27/10 |
| 10,751,637 | B1 * | 8/2020 | Kelly | F21V 23/04 |
| 10,842,244 | B2 * | 11/2020 | Ogrin | G09F 17/00 |
| 11,219,205 | B2 * | 1/2022 | Davis | A01M 31/06 |
| 2009/0280715 | A1 * | 11/2009 | Palmeiri | A63J 7/005 446/28 |
| 2015/0264986 | A1 * | 9/2015 | Coleman | A45F 3/042 362/156 |
| 2016/0220920 | A1 * | 8/2016 | Dietrick | A63J 7/005 |
| 2021/0354818 | A1 * | 11/2021 | Hardarson | A63H 27/008 |
| 2022/0000192 | A1 * | 1/2022 | Musser | A41D 27/08 |

* cited by examiner

COSTUME WING USING SYNTHETIC FEATHER FORMS

BACKGROUND OF THE INVENTION

1. Field of the Invention

The present invention is in the field of costumes and pertains particularly to methods and apparatus for constructing a feather wing costume using synthetic feather forms.

2. Discussion of the State of the Art

In the art of costume manufacturing, specific costume forms that are parts of overall costumes are typically manufactured of lightweight materials. Such forms include hats, wings, tails, and other specific forms a person might wear or attach to a worn part of an overall costume. Of the costume forms mentioned above, costume wings such as Angel wings, for example, are laborious to construct. In current art manufacture, costume wings are constructed with real feathers which must be sorted through, and which may include flaws that may appear in the final costume form. Real feathers may also be expensive and a scarce resource. Real feathers may also carry pathogens and parasites. Another construction practice in current art is to attach the feathers to a moderately rigid material.

It has occurred to the inventor that feather forms of a semi-rigid synthetic material may be created in abundance quickly and according to dimensional specification in manufacturing according to requirements with high repeatability thus eliminating flaws. It has also occurred to the inventor that synthetic feather forms attached to a fabric placed over lighter weight underlying form allows the forms to present in a more flowing and directionally appropriate manner. Therefore, what is clearly needed is a synthetic feather form and fabric lining that can be leveraged to make a feathered wing costume form.

BRIEF SUMMARY OF THE INVENTION

In one embodiment of the invention a wing costume article of manufacture is provided, comprising a semi-rigid support structure formed in a symmetrical shape emulating a shape of a set of wings, a fabric liner formed over the semi-rigid support structure, a plurality of synthetic feathers cut from synthetic foam sheet material, the synthetic feathers cut in a variety of lengths and widths, each with a first end and a second end, the second ends fastened to the fabric liner in a manner to present the plurality of feathers outward simulating a set of natural wings, and a harness interface configured to engage the wing costume by the semi-rigid support structure to the upper back of a wearer, presenting the wing costume as the set of wings.

In one embodiment the semi-rigid support structure comprises a length of plastic tubing formed into the symmetrical shape emulating the shape of a set of wings. Also, in one embodiment the semi-rigid support structure comprises a plurality of bendable light weight wires wherein the wires are tied or woven together. In one embodiment the semi-rigid support structure comprises a formed block of plastic foam material. And in one embodiment individual ones of the plurality of synthetic feathers are stitched or glued to the fabric liner at different points and extending in different directions.

In one embodiment the harness interface comprises a set of two vertically-oriented straps with buckles configured for a user to buckle over the user's shoulders to attach the wing costume to the upper back of the user. In other embodiments rope or ribbon may be used, or any other form of rope or cord material a user may use to tie on the wings. Also, in one embodiment the synthetic foam sheet material is Ethylene-Vinyl Acetate (EVA) foam material. Also, in one embodiment the synthetic foam sheet material is a polyethylene material known as Isolon™. In one embodiment the wing costume further comprises a plurality of light-emitting diodes (LEDs) joined to the synthetic feathers, together with a power supply and an on-off switch. And in one embodiment the LEDs are in a variety of colors.

In another aspect of the invention a method of creating a wing costume article of manufacture is provided, comprising forming a semi-rigid support structure formed in a symmetrical shape emulating a shape of a set of wings, covering the semi-rigid support structure with a fabric liner, cutting a plurality of synthetic feathers from synthetic foam sheet material, the synthetic feathers cut in a variety of lengths and widths, each with a first end and a second end, the second ends fastened to the fabric liner in a manner to present the plurality of feathers outward simulating a set of natural wings, and attaching a harness interface to the semi-rigid support structure in a position to mount the wing costume to the upper back of a wearer, presenting the wing costume as the set of wings.

In one embodiment the method comprises forming the semi-rigid support structure into the symmetrical shape emulating the shape of a set of wings, from a length of plastic tubing, by heating and ending the tubing. In one embodiment the method comprises forming the semi-rigid support structure into the symmetrical shape emulating the shape of a set of wings, from a plurality of bendable light weight wires wherein the wires are tied or woven together. Also, in one embodiment the method comprises forming the semi-rigid support structure into the symmetrical shape emulating the shape of a set of wings, by forming a block of plastic foam material.

In one embodiment the method comprises stitching or gluing individual ones of the plurality of synthetic feathers to the fabric liner at different points and extending in different directions. Also, in one embodiment the method comprises forming the harness interface as a set of two vertically-oriented straps with buckles configured for a user to buckle over the user's shoulders to attach the wing costume to the upper back of the user. In one embodiment the method comprises cutting the synthetic feathers from a sheet of Ethylene-Vinyl Acetate (EVA) foam material. In one embodiment the method comprises cutting the synthetic feathers from a sheet of polyethylene material known as Isolon™.

In one embodiment the method further comprises joining a plurality of light-emitting diodes (LEDs) to the synthetic feathers, together with a power supply and an on-off switch. And in one embodiment the LEDs are provided in a variety of colors.

DETAILED DESCRIPTION OF THE INVENTION

In various embodiments described in enabling detail herein, the inventor provides a unique costume emulating a feathered set of wings. The present invention is described using the following examples, which may describe more than one relevant embodiment falling within the scope of the invention.

Figure 1:
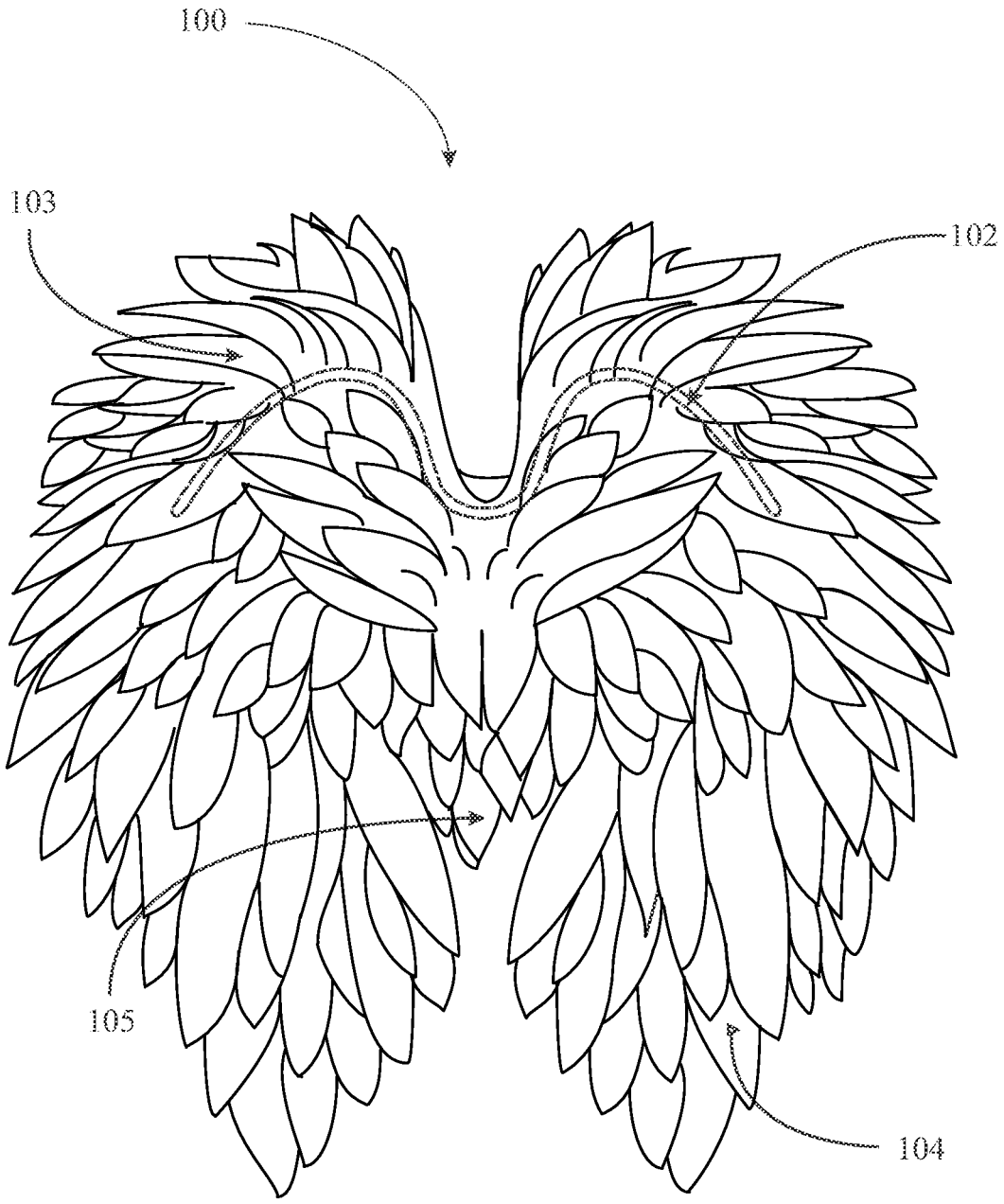
FIG. 1 is a rear elevation view of a costume wing according to an embodiment of the present invention.

FIG. 1 is a rear elevation view of a wing costume 100 according to an embodiment of the present invention. Wing costume 100 is fabricated in this example in a form of angel wings having a left and a right wing. However, in other embodiments, other wing form shapes may be represented without departing from the spirit and scope of the invention. Wing costume 100 has an internal support structure 102 (broken lines). Support structure 102 is adapted to provide a lightweight rigid or semi-rigid frame shaped generally in the form of an upper shape of a set of wings that may be enclosed in a fabric liner that may support a variety of individual feather forms that make up the overall configuration of feathers on wing costume 100.

Support structure 102 may be a lightweight and thin-walled plastic tubing that may be heated and formed into a desired shape including a symmetrical top bend formed in the top center portion to represent the division between the left and right wings, as shown. Each side of structure 102 arcs upward on each side of the top bend and then back and down on each side to support the arcuate shape. In one embodiment support structure 102 may be fabricated of a bendable light weight wire structure wherein the wires are tied or woven together to form the basic shape of the support structure including the top center bend in the structure. In another embodiment, support structure 102 may be a plastic molded form that replicates the desired shape of wing costume 100.

Wing costume 100 includes prefabricated synthetic feathers 103 disposed near the top of the wing costume, synthetic feathers 105 disposed near the center of the wing costume, and synthetic feathers 104 disposed near the bottom of the wing costume on both sides. Feathers 103, 104, and 105 may, in one embodiment, be fabricated from a sheet of ethylene-vinyl acetate (EVA) foam material. EVA foam material is a closed cellular co-polymer composite that is strong and resilient, resistive of water or moisture, easy to clean, and retains a stiff rubber-like flexibility. In an alternative embodiment, feathers 103, 104, and 105 may be fabricated from a polyethylene material known as Isolon™. Isolon™ is a closed cell cross-linked polyethylene foam material having properties similar to EVA foam material.

Feathers 103, 104, and 105 may be fabricated of differing lengths, widths, and overall feather shapes, as may be required to feather different anatomical parts of wing costume 100 to provide a realistic replication of a natural pair of wings. In one embodiment, feathers 103, 104, and 105 may be moderately translucent and white in color, mimicking, in this example, conventional wing costumes made of real feathers. In another embodiment, feathers 103, 104, and 105 may be dyed any color or colors or may be predominately opaque without departing from the spirit and scope of the invention.

In one embodiment, light emitting diodes (LEDs) may be incorporated into wing costume 100 at the level of the fabric surface at strategic points on the wings to provide illumination effects through the translucent feather forms. A small controller (on/off switch) and battery case may be incorporated into the fabric in the front side of the wing form hosting elastic straps 201 depicted in FIG. 2 described below. In an illuminated embodiment, assorted colors of light might be generated from multiple LEDs. In a variation of an illuminated embodiment, the feather forms may be decorated with glitter or other shiny light reflecting materials to further enhance the presentation of the costume.

Figure 2:
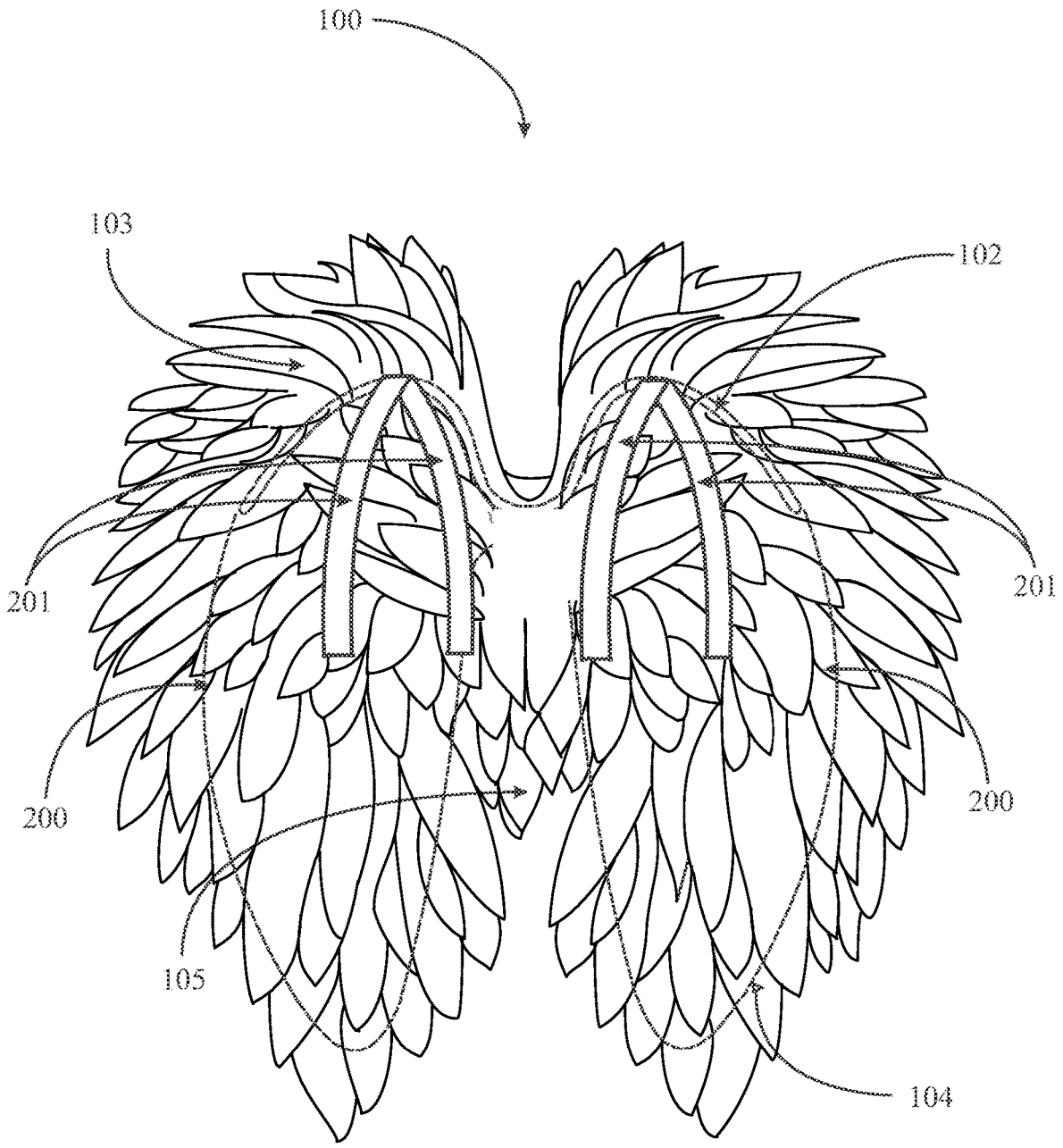
FIG. 2 is a front elevation view of the consume wing of FIG. 1.

FIG. 2 is a front elevation view of wing costume 100 of FIG. 1 adapted to be worn by a user. Synthetic feathers described above are attached by gluing or by sewing to a supporting fabric liner 200. Fabric liner 200 is, in a preferred embodiment, a double-layered polyester lining. Fabric liner 200 may be cut in the overall shape of the wing form and functions as the support material that holds the feather forms in place. Support structure 102 introduced above in FIG. 1 is positioned in between two layers of fabric liner 200 to produce the arcuate form of wing costume 100 with respect to the direction and position of each side of the wing costume.

The overall height of liner 200 may be as shown in FIG. 2, but in other embodiments may be shorter or longer, to provide wing costume sets that are relatively short, or that may extend all the way to ground level.

An attachment interface comprising straps or tie material, such as cords, strings or ropes, is provided on the rear portion of the costume as shown in FIG. 2 to enable a user to wear wing costume 100 in a manner similar to donning a backpack. In this example, a pair of elastic straps 201 are sewn at opposing ends to fabric 200 in a vertically aligned and centered position to accept the arms and shoulders of a user wearing the wing costume. The elastic straps 201 stretch to the dimensions of the user and hold wing costume 100 centered between the shoulders of the user. The straps shown are not limiting to the invention, and the tie material may take a variety of other forms.

Figure 3:
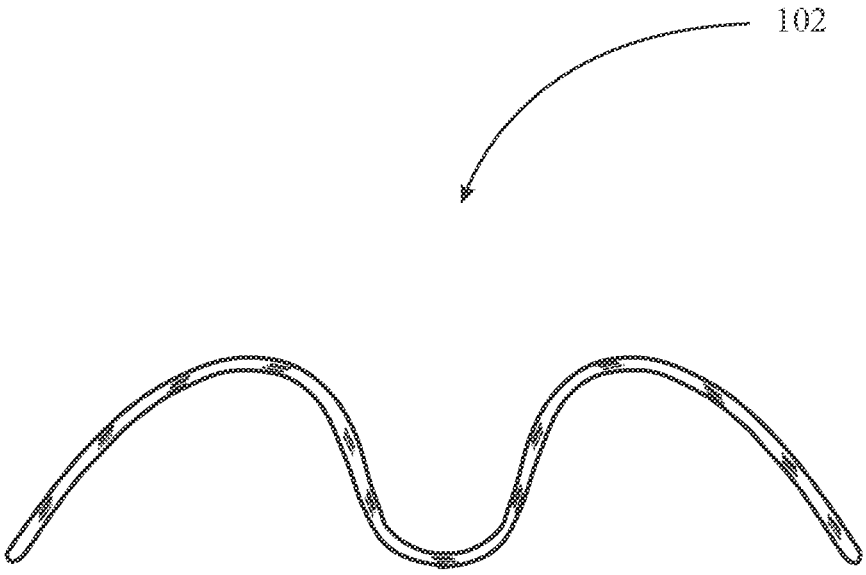
FIG. 3 is a view of the wing support structure of FIG. 1.

FIG. 3 is a rear elevation view of support structure 102 of FIG. 1. Support structure 102 in this example is made of a small diameter, lightweight plastic tubing. Other lightweight materials including thin, malleable wire may be used to construct the support structure without departing from the spirit and scope of the present invention.

In a preferred embodiment, support structure 102 is positioned between two fabric layers of the lining material, the fabric layers holding the feather forms glued or sewn together tightly over support structure at the top portion, center portion, and lower portion of the wing form to present the attached synthetic feathers appropriately at desired angles of presentation. The natural flow of the lining material provides a natural flow to the feathers of the wing costume.

Figure 4A:
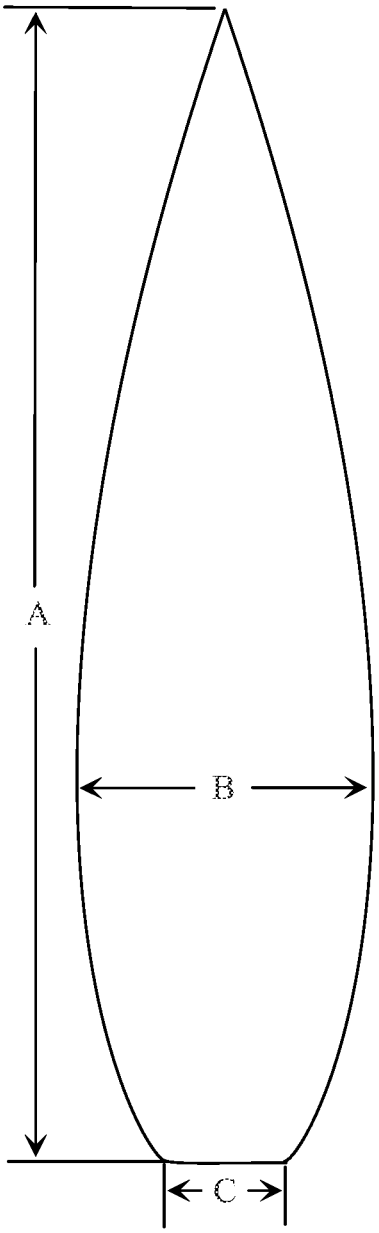
FIG. 4A is an elevation view of the synthetic feather form of FIG. 1.
Figure 4B:
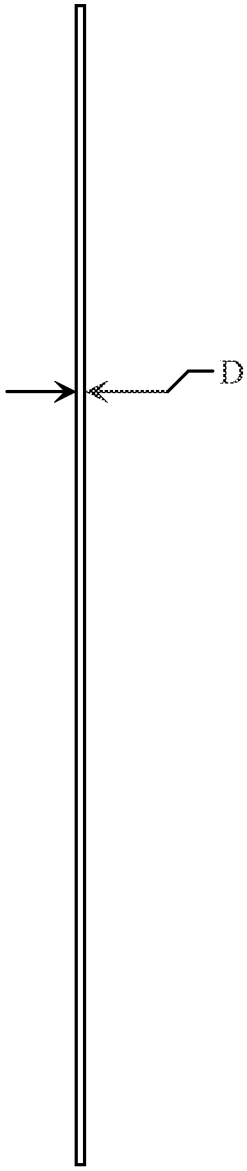
FIG. 4B is a side view of the feather form of FIG. 4A.

FIG. 4A is an elevation view of a synthetic feather 103, 104 or 105 of FIG. 1. FIG. 4B is a side view of the synthetic feather of FIG. 4A. The synthetic feather depicted may be stamped or die cut, or even manually trimmed from a sheet of EVA foam material as described further above. The synthetic feather has a general feather shape having a length dimension A, and an overall width dimension B. Dimension A and dimension B may be variable for a batch of synthetic feathers indicative of different lengths and widths of feathers required to best simulate a biological set with natural feather size and shape diversification.

In this example, the synthetic feather comes to a point at one end and has a flat bottom end with a dimension C. The flat bottom is the point of attachment that is glued onto or sewn onto the underlying fabric lining material. In a preferred embodiment the fabric lining material is analogous to material 200 of FIG. 2 or a polyester material. However, other similar material linings can be substituted therefor without departing from the spirit and scope of the present invention. Referring now to FIG. 4B, the feather form is a two-dimensional construct that has a uniform material thickness dimension D. Material thickness D is a uniform sheet thickness of the raw material used to fabricate the feathers. In a preferred embodiment, dimension D is sufficiently thick to enable the attached feathers to orientate angularly upward, self-supporting, from the surface of the fabric lining where required by design.

Figures 5A, 5B, 5C:
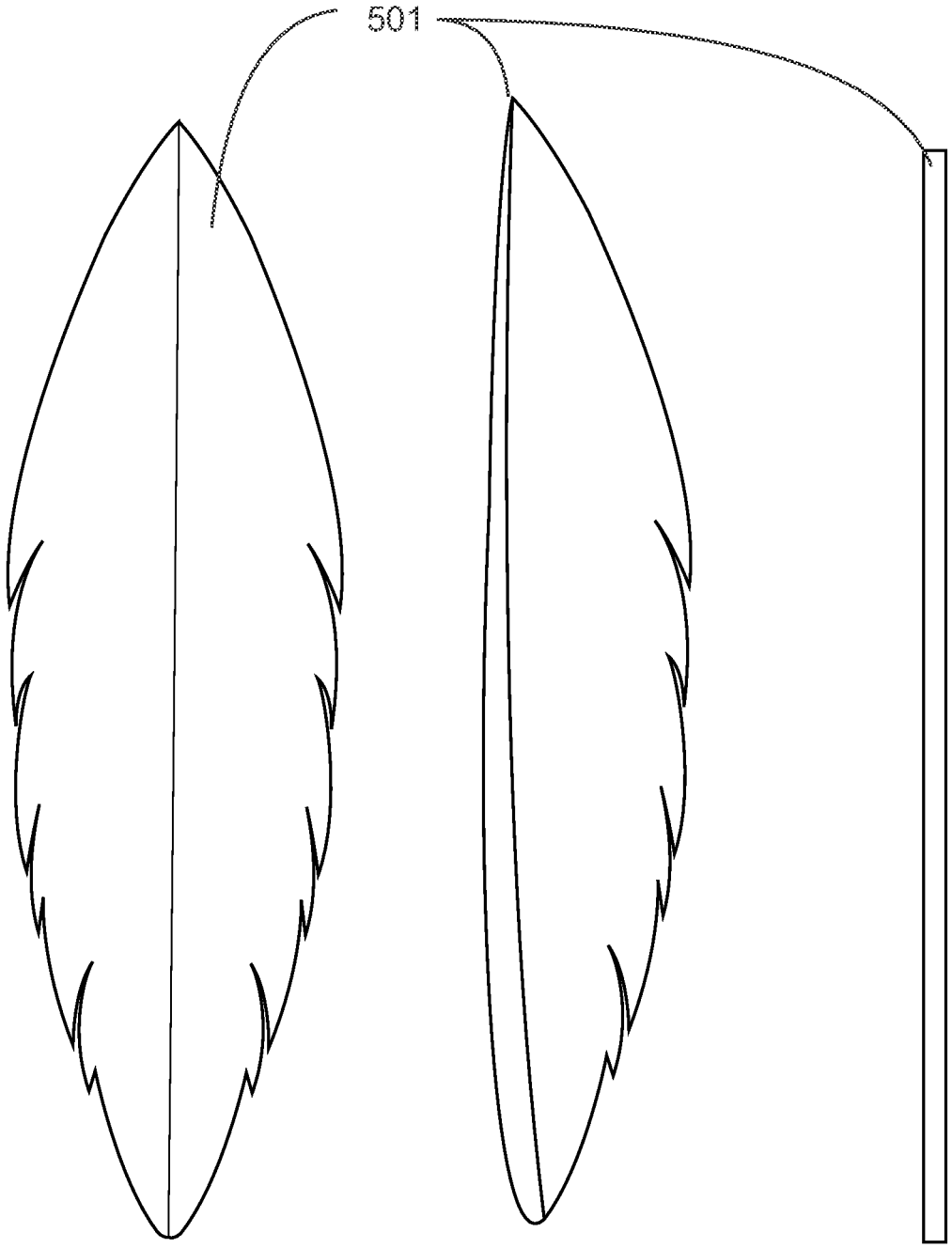
FIG. 5A is a face-on view of a synthetic feather in an alternative embodiment of the invention.
FIG. 5B is an angled view of the synthetic feather of FIG. 5A.
FIG. 5C is a side view of the synthetic feather of FIG. 5A.

FIGS. 5A, 5B and 5C are three views of an alternative form of synthetic feathers in an embodiment of the present invention. It is emphasized that the synthetic feathers can be in many sizes and shapes and forms without departing from the scope of the invention.

Figure 6:
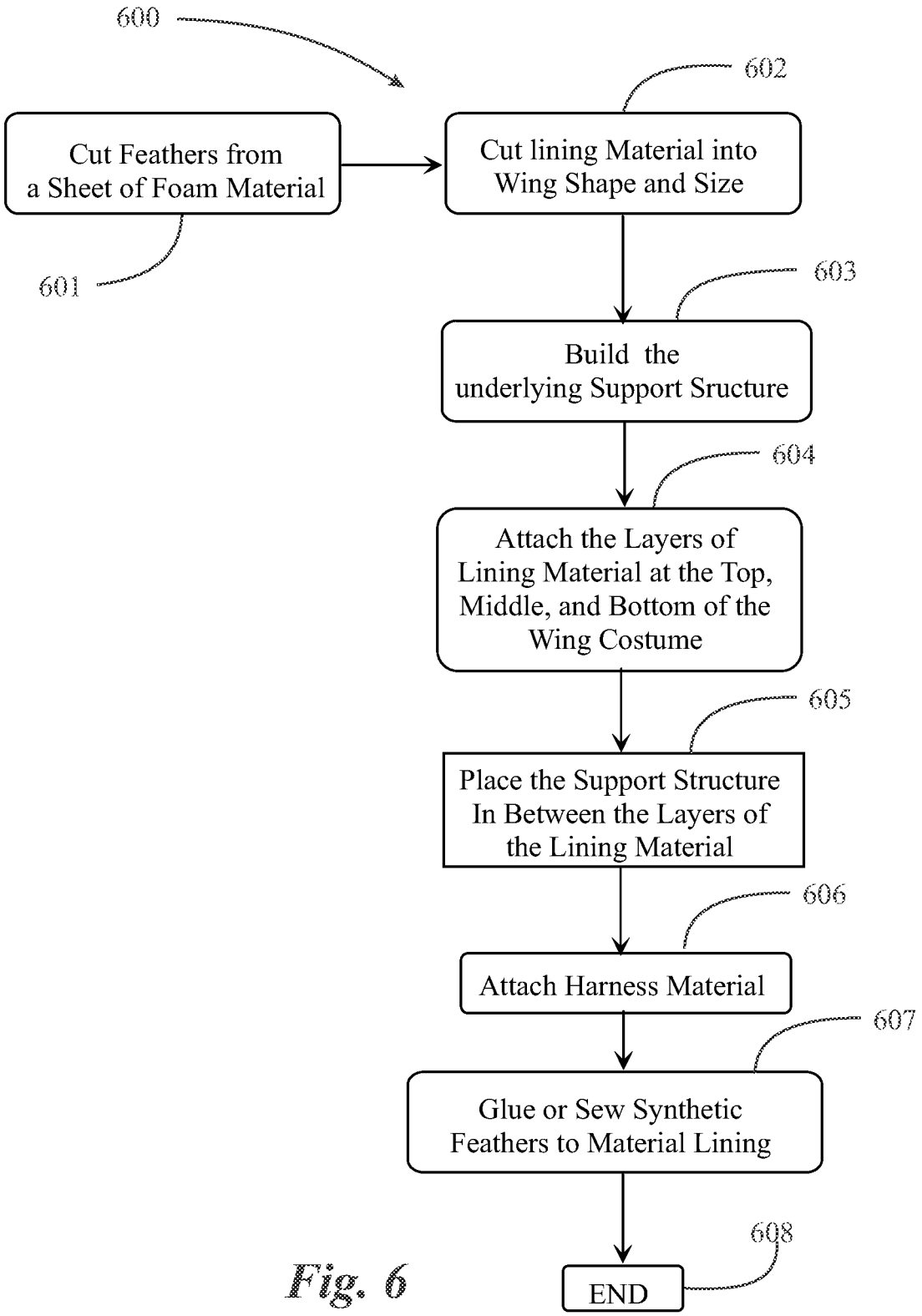
FIG. 6 is a process flow chart depicting steps for fabricating the wing costume of FIG. 1.

FIG. 6 is a process flow chart 600 depicting steps for fabricating the wing costume 100 of FIG. 1. At step 601, a user may cut the required number of and sizes of synthetic feathers from one or more sheets of synthetic material. Synthetic feathers may be cut from a foam sheet by die cutting or stamping wherein each tool has a desired shape and size for feather forms required in the design. Typically, the number of cut feathers may be sorted by size and shape for application to the underlying support fabric.

At step 602, the user may cut a wing form general shape from the fabric lining material, which laid flat provides surfaces for attaching the feathers. At step 603 the user may build the underlying support structure. As step 604 the user may attach the layers of lining material at the top, middle and bottom of the wing costume. At step 605 the user may place the support structure between the layers of the lining material. At step 606 the user may attach the harness interface. At step 607 the synthetic feathers are glued, sewed or otherwise attached to the fabric material.

It may be noted herein that process 600 may include additional steps or sub-steps such as attaching LEDs and a power and control switch, applying glitter or other reflective materials to all or portions of the feather forms to interact with or reflect the light emitted from the LEDs.

It will be apparent with skill in the art that the costume wing of the present invention may be provided using some or all the elements and process steps described herein. The arrangement of elements and functionality thereof relative to the costume wing form of the invention is described in different embodiments each of which is an implementation of the present invention. While the uses and methods are described in enabling detail herein, it is to be noted that many alterations could be made in the details of the construction and the arrangement of the elements without departing from the spirit and scope of this invention. All embodiments described above are entirely exemplary and are not limiting to the scope of the invention. The invention is limited only by the breadth of the claims below.

I claim:

1. A wing costume article of manufacture, comprising:

a support structure formed from a single piece of wire or tubing in a shape comprising a center portion, a first side portion arcing upward and away from the center portion on one side, and a second side portion arcing upward and away from the center portion on an opposite side, the support structure emulating a symmetrical upper shape of a pair of wings;

a fabric liner comprising two layers of fabric with the support structure between the two layers supporting the fabric liner extending downward from the support structure;

a plurality of synthetic feathers cut from synthetic foam sheet material, the synthetic feathers cut in a variety of lengths and widths, each with a first end and a second end and a general feather shape, the second ends fastened to the fabric liner in a manner presenting the plurality of feathers outward simulating a set of natural wings; and a harness configured to engage the wing costume by the semi-rigid support structure to the upper back of a wearer, presenting the wing costume as the pair of wings.

2. The wing costume article of manufacture of claim 1 wherein the support structure comprises a length of plastic tubing formed into the symmetrical shape emulating the upper shape of the pair of wings.

3. The wing costume article of manufacture of claim 1 wherein individual ones of the plurality of synthetic feathers are stitched or glued to the fabric liner at different points and extending in different directions.

4. The wing costume article of manufacture of claim 1 wherein the synthetic foam sheet material is Ethylene-Vinyl Acetate (EVA) foam material.

5. The wing costume article of manufacture of claim 1 wherein the synthetic foam sheet material is a polyethylene material.

6. The wing costume article of manufacture of claim 1 further comprising a plurality of light-emitting diodes (LEDs) joined to the synthetic feathers, together with a power supply and an on-off switch.

7. The wing costume article of manufacture of claim 6 wherein the LEDs are in a variety of colors.

* * * * *